US008608149B2

(12) United States Patent
Schuler Cossette

(10) Patent No.: US 8,608,149 B2
(45) Date of Patent: Dec. 17, 2013

(54) SECTIONED TABLOID PRINTING PRESS AND METHOD

(75) Inventor: Laura Schuler Cossette, Brentwood, NH (US)

(73) Assignee: Goss International Americas, Inc., Durham, NH (US)

( * ) Notice: Subject to any disclaimer, the term of this patent is extended or adjusted under 35 U.S.C. 154(b) by 841 days.

(21) Appl. No.: 12/290,214

(22) Filed: Oct. 27, 2008

(65) Prior Publication Data

US 2009/0127763 A1 May 21, 2009

Related U.S. Application Data

(60) Provisional application No. 61/000,710, filed on Oct. 26, 2007.

(51) Int. Cl.
*B41F 13/56* (2006.01)

(52) U.S. Cl.
USPC ..... 270/21.1; 270/5.02; 270/9; 101/227

(58) Field of Classification Search
USPC ..... 101/226, 227; 270/21.1, 5.01, 5.02, 270/5.03, 8, 9
See application file for complete search history.

(56) References Cited

U.S. PATENT DOCUMENTS 3,169,762 A * 2/1965 Parks ..... 270/52.29
5,067,697 A 11/1991 Honegger
5,137,304 A * 8/1992 Silverschotz et al. ..... 283/100
5,156,384 A 10/1992 Donahue
5,303,909 A * 4/1994 Maylaender ..... 270/5.01
6,139,003 A 10/2000 Michalik et al.
6,896,250 B2 * 5/2005 Hillebrand ..... 270/52.09
7,631,857 B2 * 12/2009 Hunkeler et al. ..... 270/5.03
7,721,646 B2 5/2010 Herbert et al.
7,841,276 B2 * 11/2010 Eckert et al. ..... 101/227
2006/0144507 A1 7/2006 Herbert et al.
2007/0101881 A1 5/2007 Bitzl et al.
2007/0161486 A1 7/2007 Richards
2007/0221076 A1 9/2007 Reardon

FOREIGN PATENT DOCUMENTS

DE 10 2005 036 451 A1 2/2007
WO 2005108078 A1 11/2005

* cited by examiner

*Primary Examiner* — Ren Yan
(74) *Attorney, Agent, or Firm* — Davidson, Davidson & Kappel, LLC

(57) ABSTRACT

A method for making a tabloid printed product is provided. At least one first web of material is printed, the at least one first web of material is slit to define a first ribbon bundle and a second ribbon bundle. The first ribbon bundle is then folded longitudinally. The first ribbon bundle is cut into defined lengths. The second ribbon bundle is cut unfolded into the defined lengths. The first and second ribbon bundles are combined with the first ribbon bundles being folded and the second ribbon bundles being unfolded. The second ribbon bundle is longitudinally folded over the first folded bundle after the combining step to form a sectioned tabloid newspaper. Tabloid printing presses are also provided.

14 Claims, 4 Drawing Sheets

SECTIONED TABLOID PRINTING PRESS AND METHOD

This claims the benefit of U.S. Provisional Patent Application No. 61/000,710 filed on Oct. 26, 2007 and hereby incorporated by reference herein.

BACKGROUND

The present invention relates generally to printing presses and more particularly to tabloid printing presses.

U.S. Pat. No. 6,139,003 discloses a method and a device for producing multi-layered newspaper with so-called tabloid sections. A number of paper webs, which number is variable, is admixed to the one or more webs that are provided with a longitudinal separation cut and which are fed to the one longitudinal former.

U.S. Patent Application Publication No. 2007/0221076 discloses a 3 by 2 tabloid printing press that includes a plate cylinder having a straight across lock-up and a blanket cylinder contacting the plate cylinder; a blanket cylinder printing a web; and a folder superstructure having at least one slitter for slitting the web into three ribbons and a folder for forming a tabloid newspaper from the three ribbons.

BRIEF SUMMARY OF THE INVENTION

The present invention provides a method for making a tabloid printed product. At least one first web of material is printed, the at least one first web of material is slit to define a first ribbon bundle and a second ribbon bundle. The first ribbon bundle is then folded longitudinally. The first ribbon bundle is cut into defined lengths. The second ribbon bundle is cut unfolded into the defined lengths. The first and second ribbon bundles are combined with the first ribbon bundles being folded and the second ribbon bundles being unfolded. The second ribbon bundle is longitudinally folded over the first folded bundle after the combining step to form a sectioned tabloid newspaper.

The present invention also provides a tabloid printing press. The tabloid printing press includes at least one print unit printing at least one web to define a first ribbon bundle, a second ribbon bundle and a third ribbon bundle and a first and a second former board. The first and second ribbon bundles are folded longitudinally by the first and second former boards, respectively. The tabloid printing press also includes a bypass guide roller, the third ribbon bundle passes over the bypass guide roller to recombine in an unfolded state with the folded first and second ribbon bundles. A cutter cuts the recombined ribbon bundles into signatures and a longitudinal folder, downstream of the cutter, folds the third ribbon bundle longitudinally.

The present invention further provides a tabloid printing press. The tabloid printing press includes at least one print unit printing at least one web to define a first ribbon bundle and a second ribbon bundle, a first former board, the first ribbon bundle being folded longitudinally by the first former board and a first cutter cutting the first ribbon bundle into first signatures. A second cutter cuts the second ribbon bundle into second signatures and a conveyor receives the second signatures in an unfolded state and the first signatures in a folded state on top of the second signatures. A folder folds the combined first and second signatures longitudinally.

BRIEF DESCRIPTION OF THE DRAWINGS

A preferred embodiment of the present invention will be elucidated with reference to the drawings, in which.

DETAILED DESCRIPTION OF A PREFERRED EMBODIMENT

Figure 1:
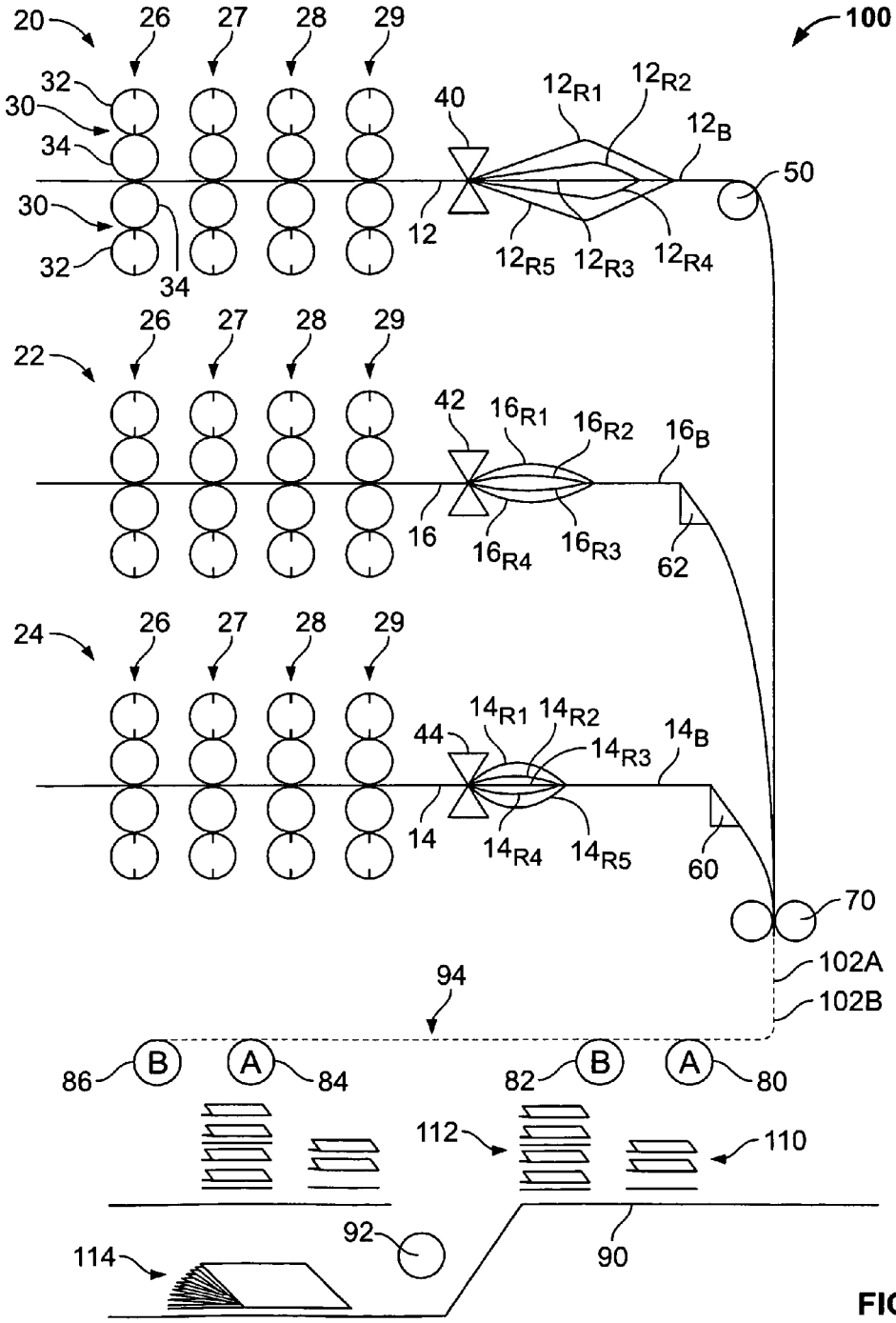
FIG. 1 shows a printing press according to a preferred embodiment of the present invention.

FIG. 1 shows a preferred embodiment of printing press 100 in accordance with the present invention. Printing press 100 includes a plurality of printing sections 20, 22, 24 each printing a web 12, 16, 14 respectively. Printing press 100 also includes slitters 40, 42, 44, a bypass guide roller 50, folding formers 60, 62, a cutter 70, diverters 80, 82, 84, 86 and a conveyor 90. Each printing section 20, 22, 24 includes four printing units 26, 27, 28, 29. Each printing unit 26, 27, 28, 29 includes two print couples 30. Each print couple 30 includes a plate cylinder 32 and a blanket cylinder 34. Plate cylinder 32 may, for example, carry one, two or four printing plates circumferentially. In the FIG. 1 embodiment, plate cylinder 32 carries two printing plates circumferentially. Printing sections 20, 22, 24 may be four-color offset printing sections where each printing unit 26, 27, 28, 29 prints a different color, for example, cyan, magenta, yellow and black.

Printing section 20 prints on web 12 running through press 100. After printing, slitter 40 slits web 12 into a plurality of ribbons, for example, five ribbons $\mathbf{12}_{R1}$, $\mathbf{12}_{R2}$, $\mathbf{12}_{R3}$, $\mathbf{12}_{R4}$, $\mathbf{12}_{R5}$ Ribbons $\mathbf{12}_{R1}$, $\mathbf{12}_{R2}$, $\mathbf{12}_{R3}$, $\mathbf{12}_{R4}$, $\mathbf{12}_{R5}$ are then recombined with each other to form a ribbon bundle $\mathbf{12}_{B}$ and pass over guide roller 50 and transported downstream to cutter 70 where ribbon bundle $\mathbf{12}_{B}$ is combined with further printed ribbon bundles.

Printing section 22 prints on web 16 running through press 100. After printing, slitter 42 slits web 16 into a plurality of ribbons, for example, four ribbons $\mathbf{16}_{R1}$, $\mathbf{16}_{R2}$, $\mathbf{16}_{R3}$, $\mathbf{16}_{R4}$. Ribbons $\mathbf{16}_{R1}$, $\mathbf{16}_{R2}$, $\mathbf{16}_{R3}$, $\mathbf{16}_{R4}$ are then recombined with each other to form a ribbon bundle $\mathbf{16}_{B}$ which is longitudinally folded by folding former 62. Folded ribbon bundle $\mathbf{16}_{B}$ is then transported downstream to cutter 70.

Printing section 24 prints on web 14 running through press 100. After printing, slitter 44 slits web 14 into a plurality of ribbons, for example, five ribbons $\mathbf{14}_{R1}$, $\mathbf{14}_{R2}$, $\mathbf{14}_{R3}$, $\mathbf{14}_{R4}$, $\mathbf{14}_{R5}$ Ribbons $\mathbf{14}_{R1}$, $\mathbf{14}_{R2}$, $\mathbf{14}_{R3}$, $\mathbf{14}_{R4}$, $\mathbf{14}_{R5}$ are then recombined with each other to form a ribbon bundle $\mathbf{14}_{B}$ which is longitudinally folded by folding former 60. Folded ribbon bundle $\mathbf{14}_{B}$ is then transported downstream to cutter 70 where it is recombined with folded ribbon bundle $\mathbf{16}_{B}$ and ribbon bundle $\mathbf{12}_{B}$. The number of ribbons formed by webs 12, 16 and 14 may be altered and may vary depending upon the number of pages desired in a final printed product. In addition, ribbon bundles $\mathbf{12}_{B}$, $\mathbf{16}_{B}$, $\mathbf{14}_{B}$ may have the same or varying widths. By varying the widths of ribbon bundles $\mathbf{12}_{B}$, $\mathbf{16}_{B}$, $\mathbf{14}_{B}$, a tabbed or indexed sectioned tabloid may be formed. See FIGS. 5 and 6.

Ribbon bundles $\mathbf{12}_{B}$, $\mathbf{16}_{B}$ and $\mathbf{14}_{B}$ are cut by cutter 70 to form signatures to form signatures 102A, 102B. Signatures 102A, 102B are then transported to diverters 80, 82, 84, 86, for example by a conveyor 94.

Diverter 80 can divert every other signature 102B and deposit signatures 102A onto conveyor 90 forming printed products 110. Signatures 102A include images A printed by printing plate 33 shown in FIGS. 3A and 3B. Diverter 82 then deposits signatures 102B on top of printed products 110 to form printed products 112. Signatures 102B include images B printed by printing plate 35 shown in FIGS. 3A and 3B. Thus, printed products 112 include both images A and images B derived from printing plate 33 and printing plate 35. Printed products 112 are further transported to a folding cylinder 92 for an inline fold. Ribbon 12 and second ribbon 12' are both folded over top of second ribbon 14' to form a sectioned printed product 114. Printed product 114 is shown in more detail in FIG. 10.

As shown in FIG. 1, an extra set of diverters 84, 86 may be used to deposit printed products 110, 112 onto conveyor 90, in which case diverters 80, 82 only need to deposit every fourth signature. The extra diverters may be desirable so folder 92 may be operated at a slower speed, for example half speed.

Figure 9:
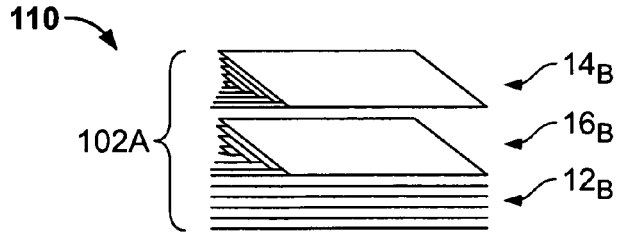
FIGS. 9 and 10 show printed products collected on a conveyor of the printing press shown in FIG. 1.

As shown in FIGS. 1, 9, printed product 110, formed from signature 102A, has an arrangement including, for example, ribbon bundle $\mathbf{14}_B$ which has been longitudinally folded and deposited on top of ribbon bundle $\mathbf{16}_B$ which has been longitudinally folded and deposited on top of ribbon bundle $\mathbf{12}_B$ which was not longitudinally folded.

Figure 8:
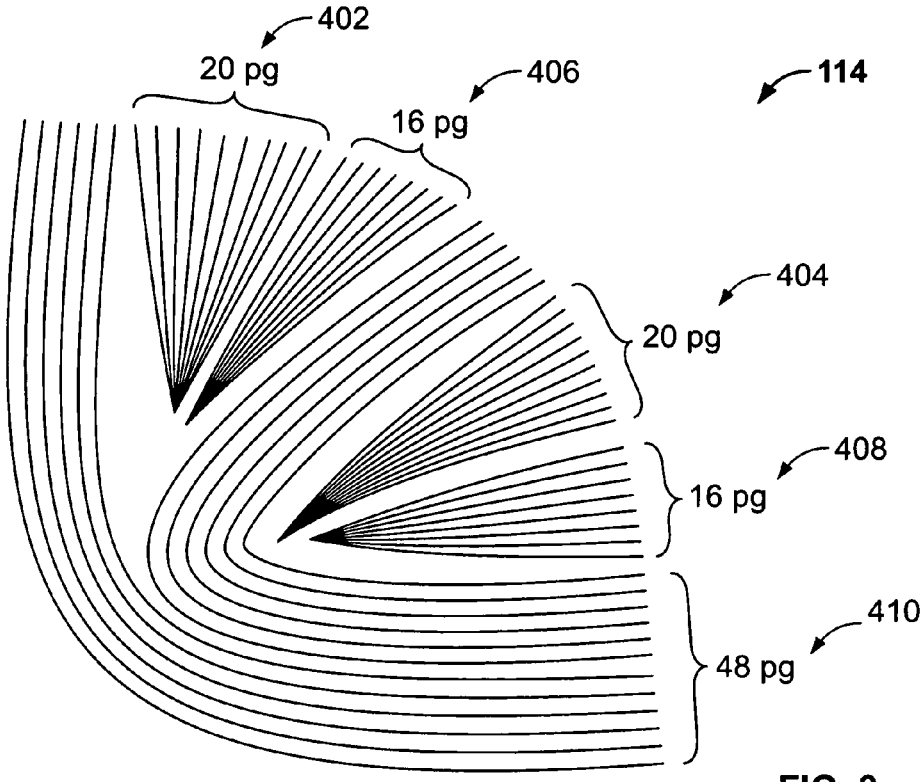
FIG. 8 shows a 120 page printed product in accordance with a preferred embodiment of the present invention.
Figure 10:
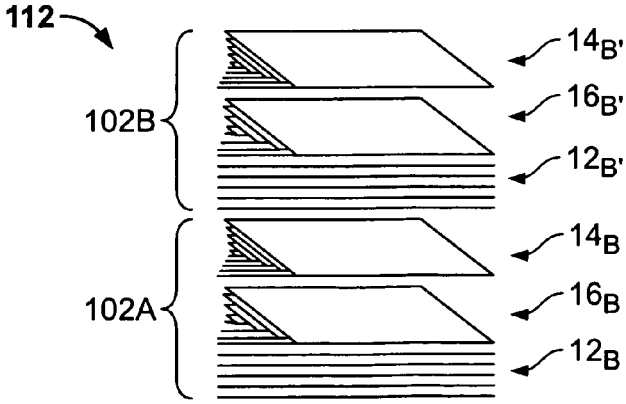

As shown in FIGS. 1 and 10, printed product 112, formed from signatures 102A and 102B, includes the same arrangement as printed product 110 and a second ribbon bundle $\mathbf{14}_B'$ which has been longitudinally folded and deposited on top of a second ribbon $\mathbf{16}_B'$ which has been longitudinally folded and deposited on top of a second ribbon $\mathbf{12}_B'$ which was not longitudinally folded. Sectioned printed product 114 is formed when folding cylinder 92 folds ribbon bundles $\mathbf{12}_B$, $\mathbf{12}_B'$ as shown in FIGS. 1 and 8.

Figure 2A:
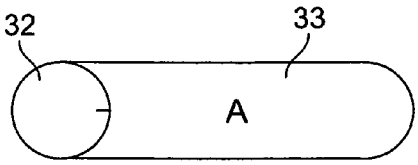
FIGS. 2A through 4B show alternate possibilities for plate cylinders of the printing press shown in FIG. 1 and images printed by the plate cylinders.
Figure 2B:
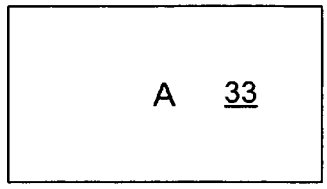
Figure 3A:
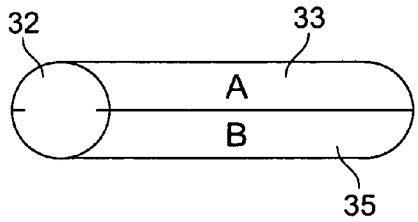
Figure 3B:
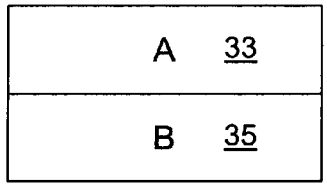
Figure 4A:
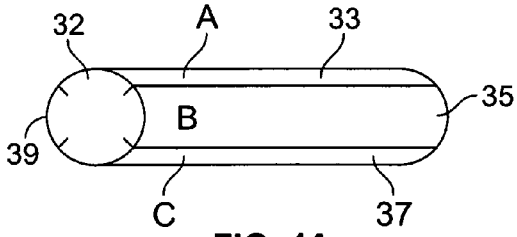
Figure 4B:
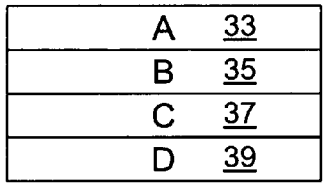

FIG. 2A shows a preferred embodiment of printing cylinder 32 carrying one printing plate 33 with an image A, with for example 4 or 5 unfolded page images axially. A web printed with this image A can for example be slit, for example into four or five ribbons, and after folding, form a sixteen or twenty page tabloid newspaper section. FIG. 2B shows one revolution of printing cylinder 32 in accordance with the FIG. 2A embodiment. FIG. 3A shows another preferred embodiment of printing cylinder 32 carrying two printing plates 33, 35, also shown in FIG. 1. FIG. 3B shows one revolution of printing cylinder 32 printing image A and image B on the web in accordance with the FIG. 3A embodiment. A web printed with images A and B for example also can be slit into several ribbons to form tabloid sections as shown in FIG. 1. FIG. 4A shows printing cylinder 32 carrying four printing plates 33, 35, 37, 39. FIG. 4B shows one revolution of printing plate 32 in accordance with the FIG. 4A embodiment. A web printed with images A, B, C and D may also be slit into a plurality of ribbons to form tabloid sections.

Figure 5:
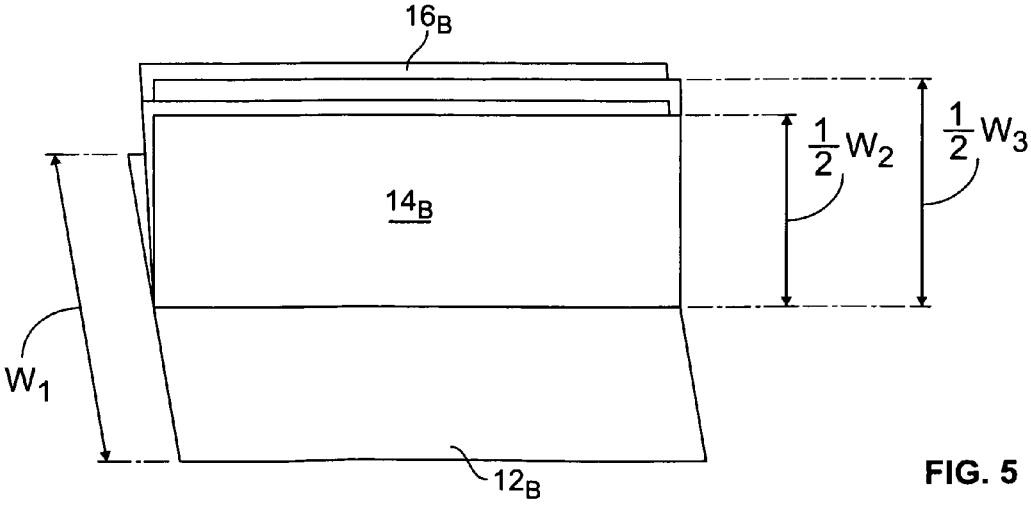
FIG. 5 shows a printed product before a final in-line fold.
Figure 6:
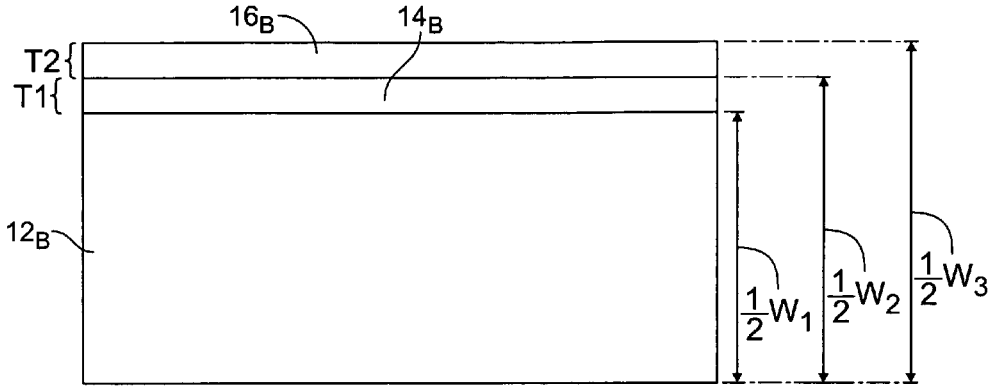
FIG. 6 shows an indexed printed product.

By varying the width of ribbon bundles $\mathbf{12}_B$, $\mathbf{14}_B$, $\mathbf{16}_B$, a final printed product preferably may be tabbed or indexed as shown in FIGS. 5 and 6. Ribbon bundle $\mathbf{12}_B$ may have a width $w_1$. Ribbon bundle $\mathbf{14}_B$ may have a width $w_2$ which is greater than $w_1$, thus ribbon bundle $\mathbf{14}_B$ extends past ribbon bundle $\mathbf{12}_B$ when both products are longitudinally folded in half. The difference between $w_2$ and $w_1$ creates a first tab $T_1$. First tab $T_1$ can be used for example, to help a reader differentiate between sections of a newspaper and/or for advertising. Similarly, ribbon bundle $\mathbf{16}_B$ has a width $w_3$ which is greater than width $w_2$ of ribbon bundle $\mathbf{14}_B$, thus forming a second tab $T_2$. However, the widths $w_1$, $w_2$ and $w_3$ may be similar in alternative preferred embodiments.

Figure 7:
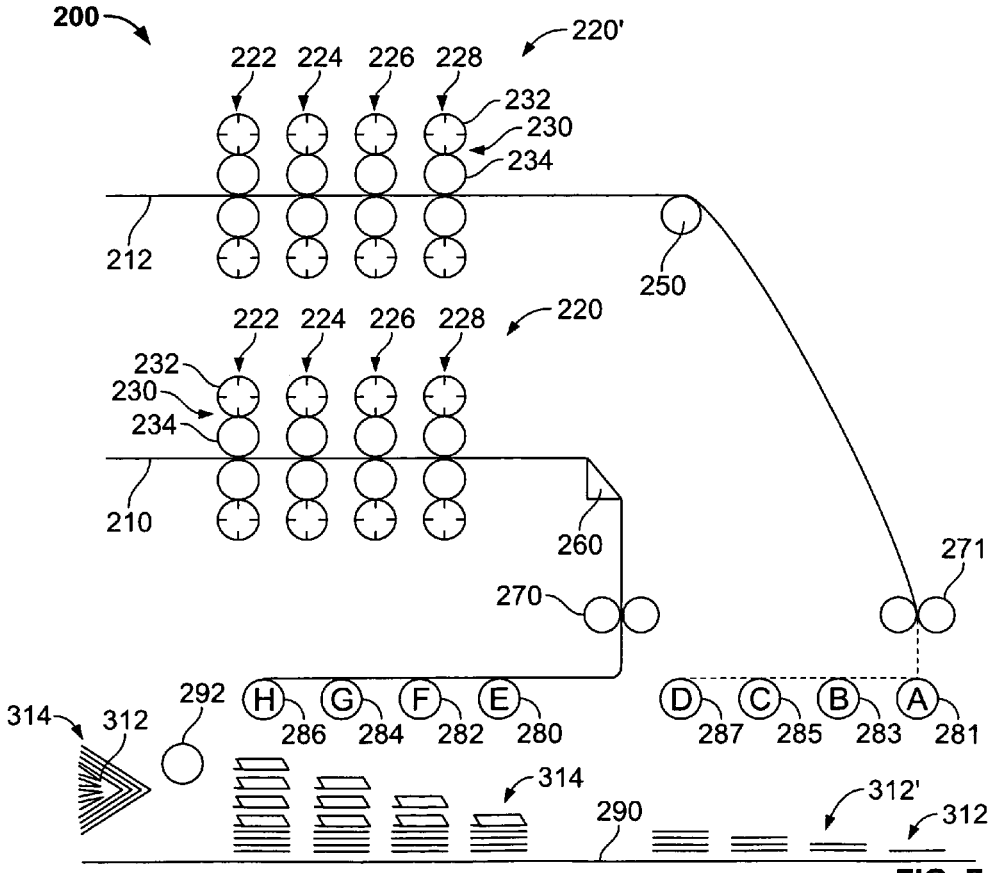
FIG. 7 shows another preferred embodiment of a printing press according to the present invention.

FIG. 7 shows another preferred embodiment of a printing press 200 according to the present invention. Printing press 200 includes printing sections 220, 220', each having four printing units 222, 224, 226, 228. Each printing unit includes two print couples 230. Each print couple 230 includes a plate cylinder 232 and blanket cylinder 234. The plate cylinders 232 may be, for example, carrying four printing plates or be imaged with four images around as shown in FIGS. 4A and 4B. A web 210 is printed by printing section 220 and passed over guide roller 250 to cutter 271 downstream. Cutter 271 cuts web 212 into signatures 312. Signatures are then transported to diverters 281, 283, 285, 287 via a conveyor. Diverters 281, 283, 285, 287 deposit signatures on conveyor 290. Each signature 312 deposited by a diverter corresponds to a printing plate as shown in FIGS. 4A and 4B. Thus, signatures 312 printed with image A are deposited by diverter 281 onto conveyor 290 while signatures 312' printed with image B are deposited by diverter 283 on top of signatures 312. Signatures 312" printed with image C are deposited by diverter 285 on top of signatures 312' and signatures 312'" printed with image D are deposited on top of signatures 312" by diverter 287.

A second printing section 220' in printing press 200 may be similar to printing section 220 as previously described. Printing section 220' prints a web 212. Folded web 210 is cut into folded signatures 314 by cutting cylinders 270 and deposited on top of signatures 312'" by diverters 280, 282, 284, 286 as signatures 312'" travel down conveyor 290. A folding cylinder 292 performs an in-line fold and folds signatures 312, 312', 312", 312'" over top of signatures 314.

FIG. 8 shows a 120 page printed product 114. Printed product 114 includes five sections. Sections 402 and 404 each include 20 pages. Sections 406 and 408 each include 16 pages. Section 410 includes 48 pages. In printed product 400, it may be advantageous for sections 402 and 408 to have tabs extending beyond section 410 and for sections 404 and 406 to have tabs extending beyond sections 402 and 408, respectively.

By changing the number of formers, diverters and ribbons or webs numerous sections may be produced and the number of pages and sections may be varied as desired. By varying the width of the ribbons, tabloid sections may be tabbed or indexed as shown in FIGS. 5 and 6.

If the printing press were wide enough, the printed web could be slit into two webs before the sections were formed.

In an alternative embodiment, multiple webs each having a different width may be combined, or any combination of slitting a web into ribbons and using multiple webs may be used.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A method for making a tabloid printed product comprising the steps of:

printing at least one first web of material, the at least one first web of material being slit to define a first ribbon bundle and a second ribbon bundle;

folding the first ribbon bundle longitudinally;

cutting the first ribbon bundle into defined lengths;

cutting the second ribbon bundle unfolded into the defined lengths;

combining the first and second ribbon bundles with the first ribbon bundle being folded and the second ribbon bundle being unfolded; and longitudinally folding the second ribbon bundle over the first folded bundle after the combining step to form a sectioned tabloid newspaper.

2. The method as recited in claim 1 wherein the combining occurs before the cutting of the first ribbon bundle.

3. The method as recited in claim 1 wherein the combining occurs after the cutting of the first ribbon.

4. The method as recited in claim 1 wherein the first and second ribbon bundles have different widths to form an indexed product.

5. The method as recited in claim 1 wherein the second ribbon bundle defines an outer section for the tabloid newspaper, and the first ribbon bundles are collected to define separate interior sections of the tabloid newspaper.

6. The method as recited in claim 1 wherein the printing includes printing two successive different images on the web for each rotation of a plate cylinder, and further comprising, after the cutting step, diverting alternating signatures so as to stack alternating signatures on top of one another.

7. The method as recited in claim 1 wherein the first and second ribbon bundles are printed with different print units.

8. The method as recited in claim 1 wherein the at least one web defines a third ribbon bundle, the third ribbon bundle being folded longitudinally and being combined with the first ribbon bundle after folding.

9. The method as recited in claim 1 wherein the step of printing includes combining a plurality of ribbons slit from the at least one web to form the first ribbon bundle.

10. The method as recited in claim 1 wherein the step of printing includes combining a plurality of ribbons slit from the at least one web to form the second ribbon bundle.

11. The method as recited in claim 1 further comprising diverting the cut first and second ribbon bundles to a conveyor.

12. The method as recited in claim 1 wherein the step of folding the first ribbon bundle longitudinally includes using a former.

13. The method as recited in claim 1 wherein the step of longitudinally folding the second ribbon bundle includes using a folding cylinder.

14. A method for making a tabloid printed product comprising the steps of:

printing at least one first web of material, the at least one first web of material being slit to define a first ribbon bundle and a second ribbon bundle;

folding the first ribbon bundle longitudinally;

cutting the first ribbon bundle into defined lengths;

cutting the second ribbon bundle unfolded into the defined lengths;

combining the first and second ribbon bundles with the first ribbon bundle being folded and the second ribbon bundle being flat; and longitudinally folding the second ribbon bundle over the first folded bundle after the combining step to form a sectioned tabloid newspaper.

* * * * *